US006213732B1

(12) United States Patent
Fujio

(10) Patent No.: US 6,213,732 B1
(45) Date of Patent: Apr. 10, 2001

(54) ROTARY COMPRESSOR

(75) Inventor: Katsuharu Fujio, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/143,084

(22) Filed: Aug. 28, 1998

(30) Foreign Application Priority Data

Aug. 28, 1997 (JP) ..... 9-232079
Apr. 15, 1998 (JP) ..... 10-104478

(51) Int. Cl.[7] ..... F04B 39/00
(52) U.S. Cl. ..... 417/312; 181/403
(58) Field of Search ..... 417/312; 181/403; 418/11, 248

(56) References Cited

U.S. PATENT DOCUMENTS 4,105,374 * 8/1978 Scharf ..... 417/415
4,582,468 * 4/1986 Bar ..... 417/312
5,242,280 * 9/1993 Fujio ..... 418/11
5,364,236 * 11/1994 Herron et al. ..... 417/312
5,584,674 * 12/1996 Mo ..... 417/312

FOREIGN PATENT DOCUMENTS 63-208688 8/1988 (JP) .
1-249977 10/1989 (JP) .
2-23289 1/1990 (JP) .

* cited by examiner

*Primary Examiner*—Andrew M. Dolinar
*Assistant Examiner*—Arnold Castro
(74) *Attorney, Agent, or Firm*—Ratner & Prestia

(57) ABSTRACT

A rolling piston type rotary compressor includes a cylindrical cylinder having a motor and a compression unit driven by the motor disposed inside of an enclosed container. A roller is externally fitted to the crank of a drive shaft coupled to the motor for moving along the inner side of the cylinder. Plural blades move in and out of the cylinder so that the leading end may slide on the outer circumference of the roller. This partitions the compression chamber formed by the inner side of the cylinder and the outer circumference of the roller nearly at same intervals. A suction port and a discharge port are disposed in each divided compression chamber, in which a common muffler chamber is disposed between the suction port of each compression chamber and the compressor external suction piping system. Each suction passage from each suction port to the muffler chamber is nearly at a same length. Equal pressure pulsation occurs in each suction passage, the suction efficiency of each compression chamber is equal, the compression torque fluctuation during one revolution of the drive shaft is dispersed, and hence the efficiency of the motor is enhanced and the vibration of the compressor piping system is reduced.

12 Claims, 13 Drawing Sheets

FIG. 6(a)
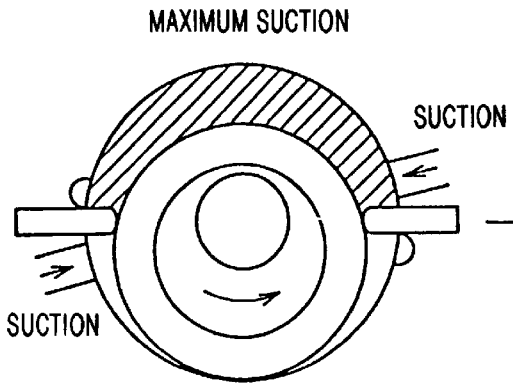
FIG. 6(b)
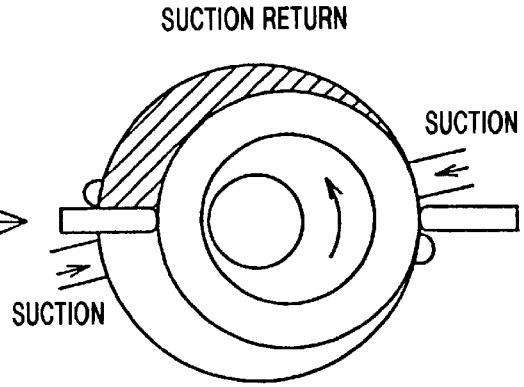
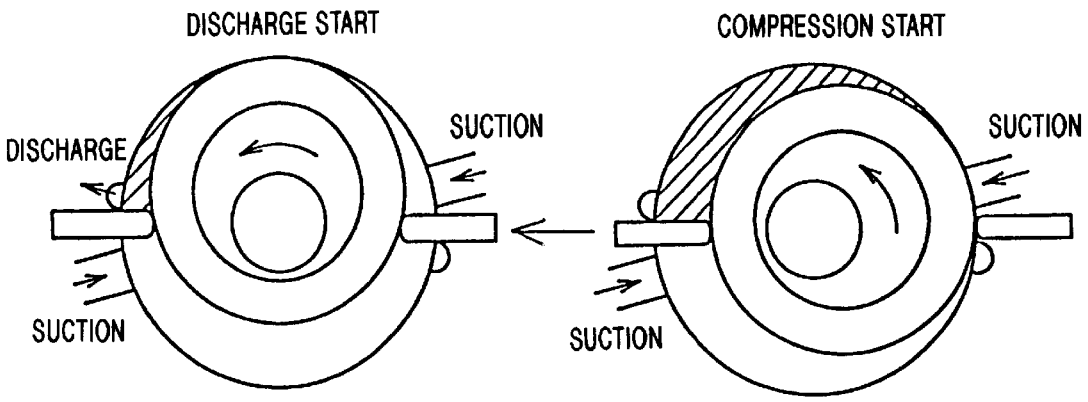
FIG. 6(d)
FIG. 6(c)

FIG. 7(a)
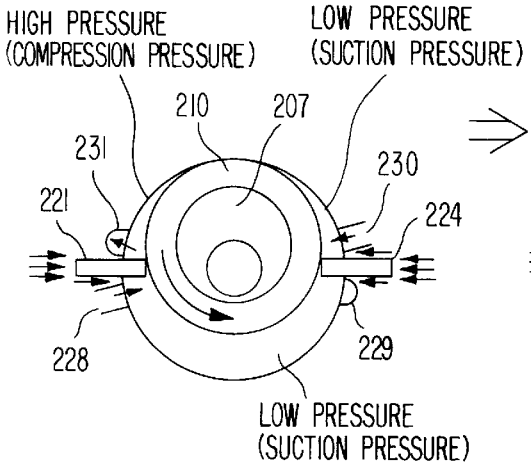
FIG. 7(b)
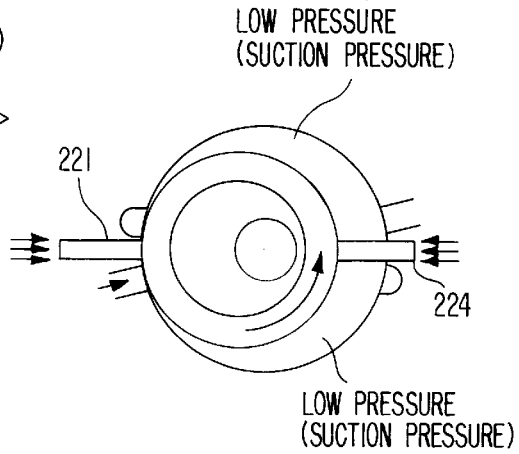
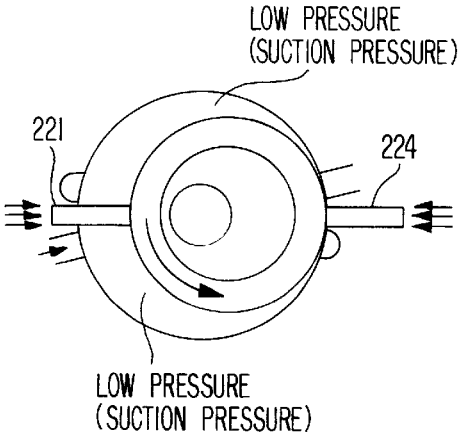
FIG. 7(d)
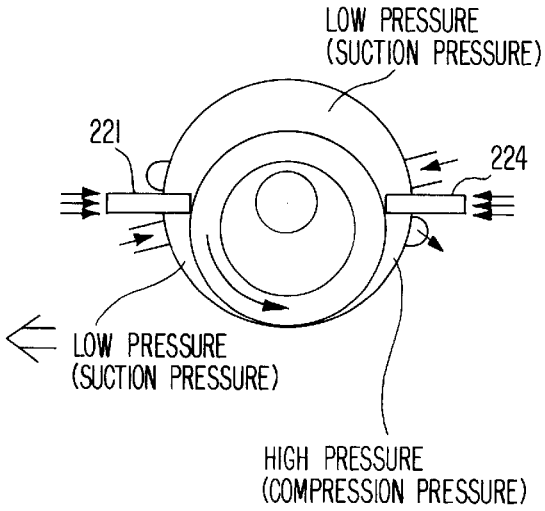
FIG. 7(c)

ROTARY COMPRESSOR

FIELD OF THE INVENTION

The present invention relates to a compressor used in an air conditioner or the like, and more particularly to a rotary piston type rotary compressor.

BACKGROUND OF THE INVENTION

The structure of a rolling piston type rotary compressor widely used in the compressor for an air conditioner is known as represented by a longitudinal sectional view in FIG. 8 and lateral sectional view of compression element in FIG. 9. In FIG. 8 and FIG. 9, the compressor comprises a motor 102 accommodated in an enclosed container 101, and a compression unit 103 driven by this motor 102. A drive shaft 106 of the compression unit 103 is coupled to the motor 102, and is supported by a main bearing 108 and a subsidiary bearing 109 disposed at both sides of a cylinder block 111. The motor 102 includes a stator 104, a rotor 105, and the drive shaft 106. Inside of the cylinder block 111 incorporating a cylinder 119, a roller 110 externally fitted to a crank unit 107 eccentric from the main shaft of the drive shaft 106 is disposed closely to the inner wall of the cylinder 119. Thus, a compression chamber 115 is formed. In a guide groove 112 of the cylinder block 111, a blade 114 and a spring device 113 for thrusting the leading end of the blade 114 to the roller 110 are disposed, and the compression chamber 115 is divided into the suction side and compression side. In the cylinder block 111, on the boundary of the blade 114, a suction port 116 opening to the cylinder 119 and a discharge port 117 are provided. An accumulator 160 for accumulating the low pressure side refrigerant is connected to the suction port 116.

In the rotary compressor in such constitution having one compression chamber 115, since compression torque fluctuations are significant, vibrations are large and the compressor piping system may be broken.

To solve such a problem, as shown in FIG. 10, a rolling piston type rotary compressor having two compression chambers in a cylinder 219 has been proposed. In FIG. 10, a first blade 221 and a first spring device 222 are disposed in a first guide groove 220 provided in a cylinder block 211, and a second blade 224 and a second spring device 225 are disposed in a second guide groove 223. Thus, a first compression chamber 226 and a second compression chamber 227 are provided. In the first compression chamber 226, a first suction port 228 and a first discharge port 229 are opened, and in the second compression chamber 227, a second suction port 230 and a second discharge port 231 are opened.

In the compressor in such constitution having two blades, the relation between the shaft rotating angle and required torque is shown in FIG. 11. As shown in FIG. 11, the compression torque action range per revolution of a drive shaft 206 is divided into two sections, and the compressor vibrations are reduced to half as compared with the compressor shown in FIG. 8. This constitution is disclosed in Japanese Laid-open Patent No. 63-208688.

On the other hand, the compressor having the first suction port 228 and second suction port 230 in the cylinder block 211 is constituted, for example, as shown in FIG. 12, in which a first accumulator 218 and a second accumulator 214 are disposed at the suction side.

To simplify the suction piping system, a constitution as shown in FIG. 13 is proposed in Japanese Laid-open Patent No. 1-249977. In FIG. 13, an accumulator 350 penetrates through a side wall of an enclosed container 301, and is connected to a suction port 349*a* of a first compression chamber. To a suction port 349*b* of a second compression chamber, the suction port 349*a* is communicating through a communication pipe 363 in the enclosed container 301. The passage entering the second compression chamber is communicating with the second compression chamber by detour. The communication pipe 363 is composed by evading the bearing boss of a main bearing 334 for supporting a drive shaft 336. That is, the length of the passage entering the second compression chamber has a path longer than the length of the passage entering the first chamber. Furthermore, the gas leaving the accumulator 350 is divided into two paths to get into the first compression chamber and second compression chamber respectively. In this case, the two divided flows of the gas are not uniform. In such conventional constitution, as mentioned below, there was a first problem relating to the flow of suction gas.

The principle of compression of the compressor forming two compression chambers in the cylinder by disposing two blades in one cylinder block is as shown in FIG. 6. That is, the shaded area in FIG. 6 (*a*) shows the state of maximum suction stroke volume in the compression chamber. The shaded area in FIG. 6 (*b*) shows the compression chamber immediately before closure of the suction port in the state of minimum suction stroke volume in the compression chamber, which is reduced from the state of the maximum suction stroke volume in FIG. 6 (*a*). This decrease in the suction stroke volume means that the suction gas flows back to the suction piping system through the suction port. The shaded area in FIG. 6 (*c*) shows the state of substantial start of compression after closure of the suction port. The shaded area in FIG. 6 (*d*) shows the state of discharge from the compression chamber through suction port and suction valve as a result of elevation of compression chamber pressure. Thus, flow-in and counter-flow of suction gas occur in the suction and compression strokes. Accordingly, the suction route is unevenly divided into two flows as shown in FIG. 13, and the path lengths of two divided flows are different, and in such constitution, therefore, pulsations occurring in the suction passage interfere with each other, thereby resulting in increase of suction passage resistance and significant drop of compression efficiency.

There was also a second problem. FIG. 7 shows a pressure state in each cylinder at each compression stroke. In FIG. 7 (*a*), the pressure in the cylinder opposite to the second plate 224 is low on both sides, and the pressure in the cylinder opposite to the first blade 221 is low on one side, and high on the other. Therefore, the roller side leading end of the second blade 224 and the roller 210 contact with each other by both thrusting forces, that is, the thrusting force of the second spring device 225 acting on the second blade 224 and the thrusting force by the differential pressure of the discharge pressure and suction pressure.

On the other hand, the roller side leading end of the first blade 221 and the roller 210 contact with each other by the combined thrusting force of the thrusting force of the first spring device 222 acting on the first blade 221, and the differential thrusting force of the thrusting force by refrigerant gas pressure distribution from the cylinder inside acting on the roller side leading end of the first blade (the thrusting force on the basis of the distribution rate of the compression intermediate pressure and the distribution rate of the suction pressure) and the thrusting force by discharge pressure. The contacting force of the first blade 221 and roller 210 and the contacting force of the blade 1141 and roller 110 in FIG. 9 are equal to each other.

In FIG. 7 (*b*), the pressure in the cylinder opposite to the first blade 221 and second blade 224 is low (suction pressure) on both sides. Therefore, the first blade 221 and the roller 210 of the roller side leading end of the second blade 224 contact with each other by receiving the same thrusting force as the second blade 224 in FIG. 7 (*a*).

In FIG. 7 (*c*), the pressure in the cylinder opposite to the first blade 221 is low on both sides, and the pressure in the cylinder opposite to the second blade 224 is low on one side and high on the other. Therefore, the roller side leading end of the first blade 221 and the roller 210 contact with each other by receiving the same thrusting force as the blade 224 in FIG. 7 (*a*). The second blade 224 contacts with the roller 210 by receiving the same thrusting force as the first blade 221 in FIG. 7 (*a*).

In FIG. 7 (*d*), moreover, the pressure in the cylinder opposite to the first blade 221 and second blade 224 is low (suction pressure) on both sides. Therefore, the first blade 221 and the roller 210 at the roller side leading end of the second blade 224 contact with each other by receiving the same thrusting force as the second blade 224 in FIG. 7 (*a*).

That is, from FIG. 7 (*d*) to FIG. 7 (*a*) and FIG. 7 (*b*), in other words, until the crank 207 rotates 180 degrees, the roller side leading end of the second blade 224 and the roller 210 contact with each other by the two thrusting forces, that is, the thrusting force of the second spring device 225 acting on the second blade 224, and the thrusting force by the differential pressure of discharge pressure and suction pressure.

On the other hand, from FIG. 7 (*b*) to FIG. 7 (*c*) and FIG. 7 (*d*), in order words, until the crank 207 rotates 180 degrees, the roller side leading end of the first blade 221 and the roller 210 contact with each other by the both thrusting forces, that is, the thrusting force of the first spring device 222 acting on the first blade 221 and the thrusting force by the differential pressure of discharge pressure and suction pressure.

As a result, the first blade 221 and the roller side leading end of the second blade 224 is greater in the contacting force than between the blade 114 and roller 210 in FIG. 7, and the wear occurs earlier than in the rolling piston type rotary compressor of the prior art. As a result, the durability of the first blade 221, second blade 224 and roller 210 is lowered.

SUMMARY OF THE INVENTION

A compressor of the invention comprises (a) a motor, (b) a compressing means installed in an enclosed container, the compressing means including
  (1) a cylinder block having a cylinder with a cylindrical inner side,
  (2) a roller connected to a drive shaft coupled to the motor, for moving along the inner side of the cylinder,
  (3) plural blades moving back and forth from the cylinder block into the cylinder, and sliding on the outer side of the roller, and
  (4) plural compression chambers enclosed by the inner side of the cylinder block, outer side of the roller, and plural blades, each compression chamber of the plural compression chamber having a suction port and a discharge port, (c) a muffler chamber communicating with each suction port of the plural compression chambers, (d) each passage disposed between the each suction port and the muffler chamber, and (d) an external piping communicating with the muffler chamber.

In particular, the each passage has nearly the same length mutually.

Preferably, the distance between mutually adjacent passages of the passages is equal.

Preferably, the roller includes an inside roller, and an outside roller disposed outside of the inside roller, the outer circumference of the inside roller slides on the inner circumference of the outside roller, and the plural blades slide on the outer circumference of the outside roller.

In this constitution, the compression efficiency is enhanced, and vibrations of the passage are extremely decreased, and therefore breakage of the piping mechanism can be prevented.

Still more, the durability of the blades and roller is extremely enhanced, and an excellent compression efficiency can be maintained for a long period.

BRIEF DESCRIPTION OF THE DRAWINGS

FIG. 6 is a diagram useful for explaining the principles of compression of a compressor;

FIG. 7 is a diagram useful for explaining the pressure state in each cylinder at each compression stroke of the compressor;

DETAILED DESCRIPTION

Figure 1:
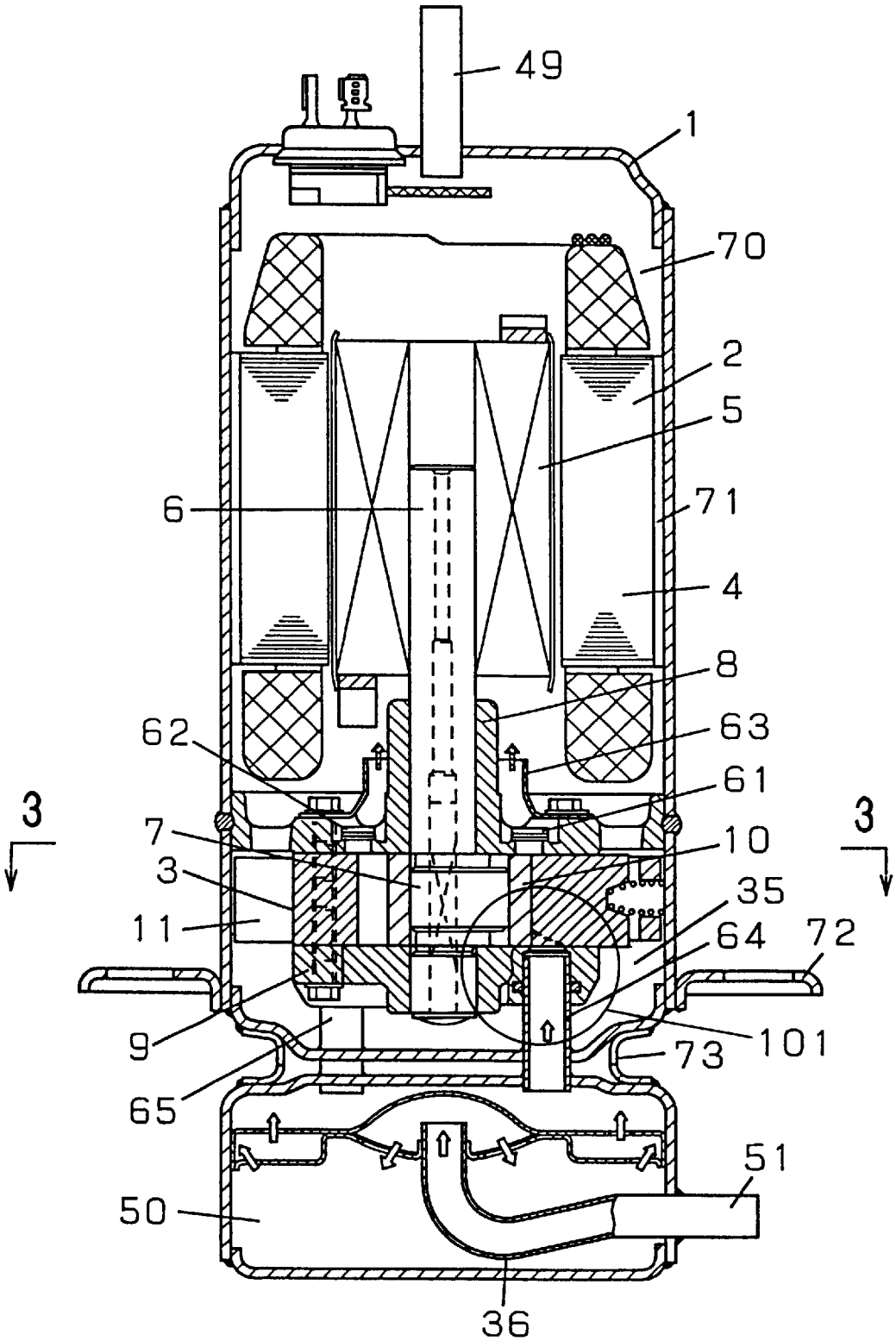
FIG. 1 is a longitudinal sectional view of a rolling piston type rotary refrigerant compressor in accordance with an exemplary embodiment of the present invention.
Figure 2:
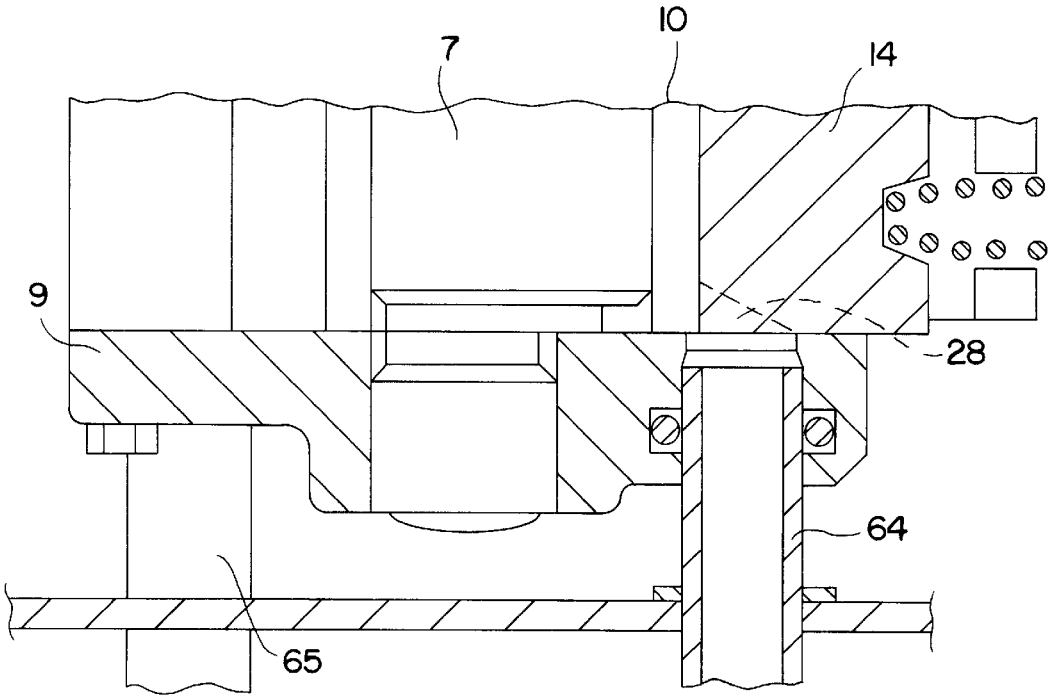
FIG. 2 is a partially magnified view of FIG. 1.

Referring now to the drawings, preferred embodiments of the invention are described below.

Embodiment 1

FIG. 1 is a longitudinal sectional view of rolling piston type rotary refrigerant compressor. In FIG. 1, a motor 2 is installed in the upper part of inside of an enclosed container 1, and a compression unit 3 is disposed in the lower part. A discharge pipe 49 connecting to an external piping system of the compressor is connected to the upper space of the motor 2. A muffler chamber 50 communicating with the suction side of the compression unit 3 is disposed outside of the bottom of the enclosed container 1 and a suction pipe 51 is connected to the muffler chamber 50. The compression unit 3 has a main bearing 8 and a subsidiary bearing 9 internally fixed in the enclosed container 1, on both sides of a cylinder block 11. A drive shaft 6 coupled to a rotor 5 of the motor 2 is supported by the main bearing 8 and subsidiary bearing 9, and a roller 10 is fitted to a crank 7 of the drive shaft 6.

Figure 3:
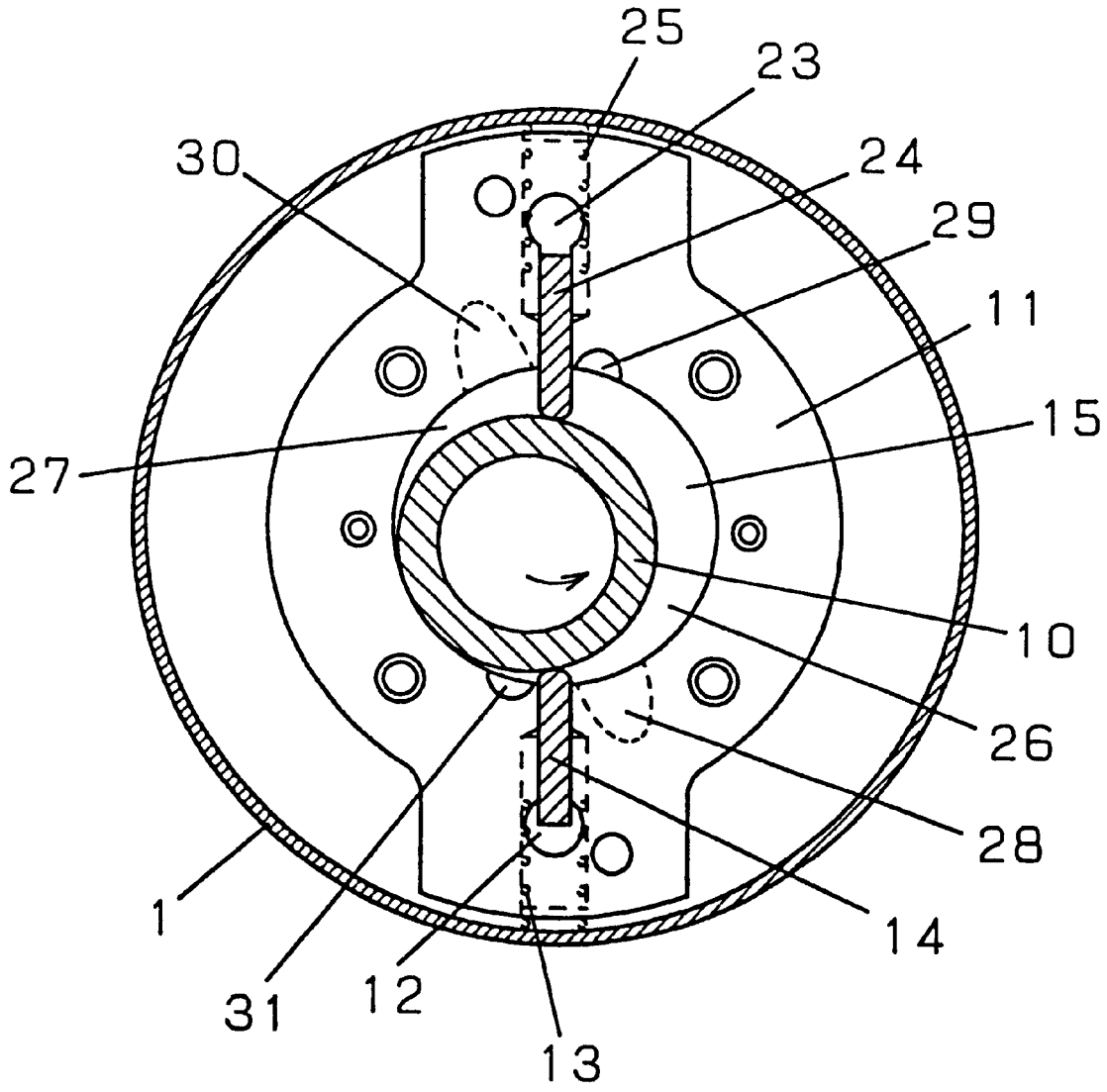
FIG. 3 is a lateral sectional view along line 3—3 in FIG. 1.

As shown in FIG. 3, a first blade 14 is fitted in a first guide groove 12 provided in the cylinder block 11, and the leading end of the first blade 14 is pressed to the roller 10 by a first spring device 13. In a guide groove 23 provided at the opposite side position, a second blade 24 is fitted, and the leading end of the second blade 24 is pressed to the roller 10 by a second spring device 25.

A first suction port 28 and a second suction port 30 opening to a first compression chamber 26 and a second compression chamber 27 partitioned by the first blade 14 and the second blade 24 are disposed at symmetrical positions, forming a notch in the cylinder wall, at the mounting side of the subsidiary bearing 9 of the cylinder block 11. A first discharge port 29 and a second discharge port 31 are disposed at symmetrical positions at the mounting side of the main bearing 8 of the cylinder block 11.

A first discharge valve device 61, a second discharge valve device 62, and a discharge guide 63 are disposed in the main bearing 8, and form a part is of a discharge refrigerant passage.

One end of a first communication pipe 64 communicating with the first suction port 28 is opposite to both first compression chamber 26 and first suction port 28, and one end of a second communication pipe 65 communicating with the second suction port 30 is opposite to both second compression chamber 27 and second suction port 30, and other end of the second communication pipe 65 penetrates through the subsidiary bearing 9 and the bottom of the enclose container 1 and communicates with the muffler chamber 50. The passage of the first compression chamber 26 and muffler chamber 50 has the first communication pipe 64. The passage of the second compression chamber 27 and muffler chamber 50 has the second communication pipe 65.

Opening ends of the first communication pipe 64 opposite to the first compression chamber 26 and the second communication pipe 65 opposite to the second compression chamber 27 are disposed so as to be opened and closed intermittently by the end of the roller 10. The first communication pipe 64 and second communication pipe 65 are fixed by silver-alloy brazing between the bottom of the enclosed container 1 and the outer wall of the muffler chamber 50, so as to support the muffler chamber 50.

The upper space and lower space of a motor compartment 70 for accommodating the motor 2 communicate with each other through a cooling passage 71 provided outside of a stator 4 of the motor 2. An oil sump 35 communicates with the lower space of the motor compartment 70. A tiny hole 36 is formed in a part of the suction pipe 51 invading into the muffler chamber 50. An auxiliary fixing member 73 and a compressor support base 72 are disposed for fixing the enclosed container 1 and the muffler chamber 50.

In thus constituted rolling piston type rotary compressor, the operation is described below. As the drive shaft 6 coupled to the rotor 5 of the motor 2 rotates, according to the principle of compression shown in FIG. 6, the refrigerant gas is sucked and compressed in the first compression chamber 26 and second compression chamber 27, respectively, and the refrigerant gas runs through the passage of the first discharge valve device 61, second discharge valve device 62, main bearing 8 and discharge guide 63, and is discharged into the motor compartment 70. Part of lubricating oil contained in the refrigerant gas is separated to return to the oil sump 35, while the remaining lubricating oil is sent out to outside of the compressor through the discharge pipe 49 together with the refrigerant gas. When the discharge refrigerant gas passes inside the discharge guide 63, the main bearing 8 is cooled.

On the other hand, the refrigerant gas (including lubricating oil) flowing into the muffler chamber 50 from the low pressure side of the refrigerant cycle piping system through the suction pipe 51 collides against the obstruction wall, and then changes its flow direction, and at this time, part of the lubricating oil is separated by the inertial force of the lubricating oil, and then it flows alternately into the suction side of the first compression chamber 26 and second compression chamber 27 through the first communication pipe 64 and second communication pipe 65.

In the first compression chamber 26 and second compression chamber 27, the suction refrigerant gas in the suction stroke moves in and out of the first communication pipe 64 and second communication pipe 65 by the principle of suction and compression explained in FIG. 6. Since the first communication pipe 64 and second communication pipe 65 are both short and in the same length, the suction refrigerant gas flowing back in the first communication pipe 64 communicating with the first compression chamber 26 is instantly sucked into the second communication pipe 65 communicating in the suction stroke of the second compression chamber 27 through the muffler chamber 50. Thus, pulsations of the suction refrigerant gas occurring in the muffler chamber 50 can be suppressed.

Incidentally, when the refrigerant gas flows back from the first compression chamber 26 and second compression chamber 27 into the muffler chamber 50, since the first communication pipe 64 and second communication pipe 65 are designed so as not to change the flow direction of the refrigerant gas (that is, the opening end of the first communication pipe 64 is opposite to both first compression chamber 26 and first suction port 28, and the opening end of the second communication pipe 65 is opposite to both second compression chamber 27 and second suction pipe 30), the passage resistance is extremely small when the refrigerant gas is discharged into the muffler chamber 50 from the first compression chamber 26 and second compression chamber 27.

As a result, when the refrigerant gas flows back in the first communication pipe 64 and second communication pipe 65, the pressure elevation in the suction stroke in the first compression chamber 26 and second compression chamber 27 is almost zero. By the negative pressure generated when the refrigerant gas passes through the suction pipe 51, the lubricating oil staying in the bottom of the muffler chamber 50 is sucked up through the tiny hole 36, and is mixed into the suction refrigerant gas.

Thus, according to the exemplary embodiment, a common muffler chamber 50 is installed among the first suction port 28 of the first compression chamber 26, the second suction port 30 of the second compression chamber 27, and the external suction piping system of the compressor, and the length of the first communication pipe 64 between the first suction port 28 and the muffler chamber 50 is nearly same as the length of the second communication pipe 65 between the second suction port 30 and the muffler chamber 50. In this constitution, when part of the refrigerant gas sucked into the first compression chamber 26 and second compression chamber 27 temporarily flows back into the first suction port 28 and second suction port 30, pulsations occur in the first communication pipe 64 and second communication pipe 65 in the same magnitude at a phase difference of 180 degrees. Accordingly, due to effects of pulsations, the suction efficiency and each compression torque fluctuation of the first compression chamber 26 and second compression chamber 27 occur symmetrically, so that torque fluctuations in one revolution of the drive shaft 6 can be dispersed. As a result, the motor efficiency is enhanced, and vibrations of compressor piping system are reduced.

Besides, each pulsation refrigerant gas propagating to the muffler chamber 50 through the first communication pipe 64 and second communication pipe 65 is reduced in the muffler chamber 50. That is, the refrigerant gas flowing back from the first communication pipe 64 is sucked into the second communication pipe 65 through the muffler chamber 50, and the refrigerant gas pulsation propagating from the first communication pipe 64 is reduced. As a result, the refrigerant gas pulsation does not propagate to the external suction piping system of the compressor through the suction pipe 51, so that the vibration of the compressor external suction piping system can be decreased.

Moreover, since extreme oversupply of suction refrigerant gas does not occur, excessive compression load can be prevented.

Also according to the embodiment, the muffler chamber 50 is installed at the subsidiary bearing 9 side, and the first discharge port 29 and second discharge port 31 are disposed at the main bearing 8 side, and therefore the distance between the main bearing 8 and the motor 2 is short, which is the same as in the conventional rotary compressor, and the bending deformation of the drive shaft 6 is decreased. As a result, the compressor vibration and bearing wear due to imbalance of the rotary driving system are decreased.

Still more, since the muffler chamber 50 in the space necessary for absorbing pulsation can be installed in a desired state, the pulsation attenuation effect can be enhanced.

Further according to the exemplary embodiment, since the first communication pipe 64 and second communication pipe 65 are disposed by penetrating through the subsidiary bearing 9 in the axial direction, each suction passage to the muffler chamber 50 is shorter, and the magnitude of pulsation is decreased. As a result, the vibration in the external suction piping system of the compressor is reduced, and the compressor suction efficiency can be improved.

According to the exemplary embodiment, by disposing the muffler chamber 50 outside of the end wall of the enclosed container 1 at the subsidiary bearing 9 side, penetrating through the end wall of the enclosed container, installing the first communication pipe 64 between the first suction port 28 and muffler chamber 50, and installing the second communication pipe 65 between the suction port 30 and muffler chamber 50, the suction passage is shortened, heating of the muffler chamber 50 is prevented, and the compression efficiency is enhanced.

According to the exemplary embodiment, moreover, by disposing the muffler chamber 50 outside of the end wall of the enclosed container 1 at the subsidiary bearing 9 side, and disposing first communication pipe 64 and second communication pipe 65 to penetrate through the subsidiary bearing 9 and the end wall of the enclosed container 1, the suction passage can be further shortened, pulsation occurring inside the communication pipe 64 and communication pipe 65 can be decreased, and heating of suction refrigerant gas can be prevented.

In the exemplary embodiment, by holding mainly the muffler chamber 50 in the enclosed container 1 by the first communication pipe 64 and second communication pipe 65 for composing the suction passage, the muffler chamber 50 can be disposed easily in the enclosed container 1.

In the exemplary embodiment, further, since the opening positions of the first communication pipe 64 and second communication pipe 65 to the muffler chamber 50 are nearly symmetrical to the center of the muffler chamber 50, the pulsation attenuation action in the muffler chamber 50 can be enhanced, and the vibration in the suction piping system can be decreased.

Further according to the exemplary embodiment, by disposing the utmost downstream end of the suction pipe 51 connecting to the compressor external suction piping system nearly in the common center to the openings of the first communication pipe 64 and second communication pipe 65 to the muffler chamber 50, the pulsation attenuation action in the muffler chamber 50 can be further increased, and the compression efficiency is enhanced and the vibration of the suction piping system can be decreased.

Embodiment 2

Figure 4:
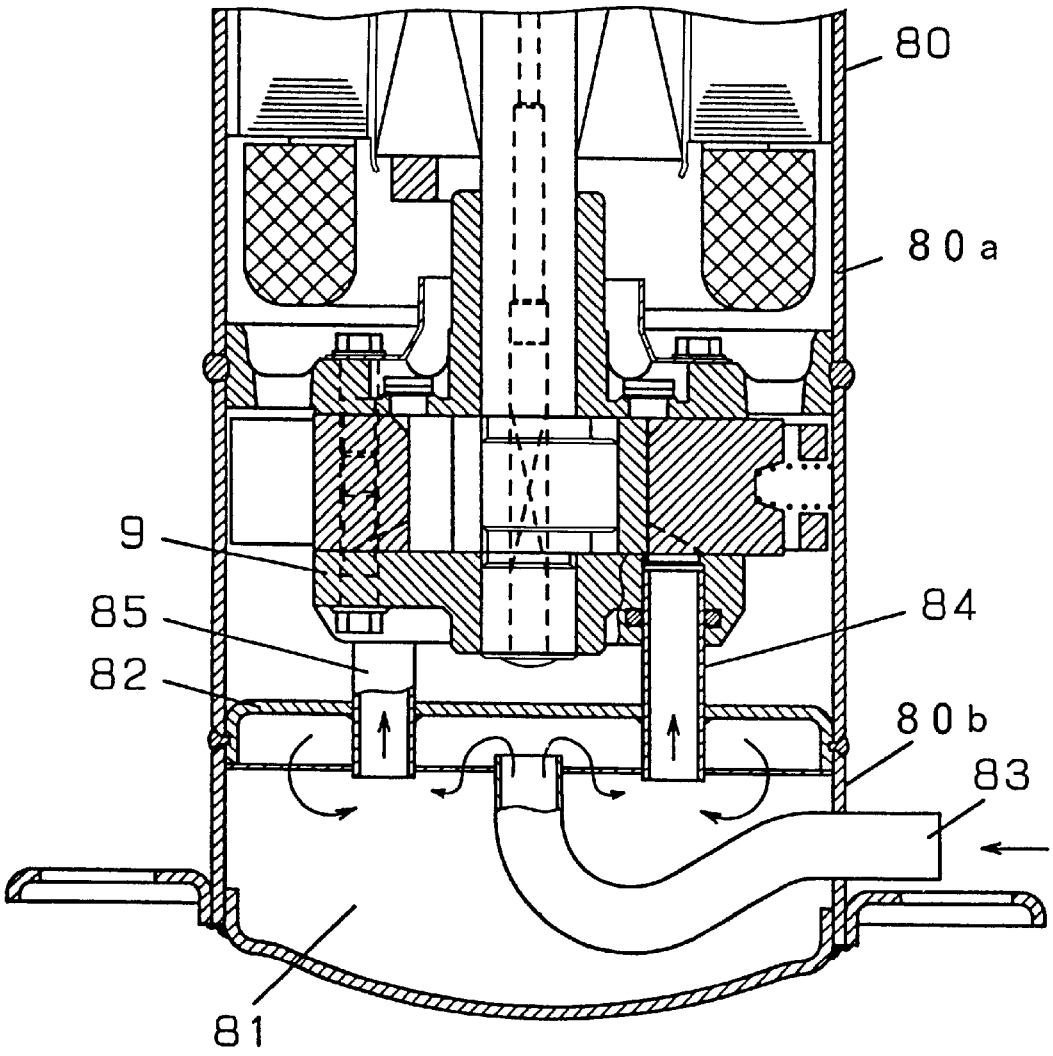
FIG. 4 is a sectional view of a rolling piston type rotary refrigerant compressor in accordance with a further exemplary embodiment of the present invention.

FIG. 4 shows a constitution of a refrigerant compressor incorporating a muffler chamber 81 in an enclosed container 80. The inside of the enclosed container 80 is divided into an upper high pressure space and a lower muffler chamber 81 by means of a partition member 82. The outer circumference of the partition member 82 is tightly welded to the end of the upper enclosed container 80*a* and the end of the lower enclosed container 80*b*. The utmost downstream end of a suction pipe 83 is set at a position higher than the lower end of a first communication pipe 84 communicating with a first suction port 28, and the lower end of a second communication part 85 communicating with a second suction pipe 30. Thus, the refrigerant gas flowing into the muffler chamber 81 from the suction pipe 83 is prevented from flowing directly into the first communication pipe 84 and second communication pipe 85 without separating the lubricating oil. The other constitution is the same as in FIG. 1.

According to the exemplary embodiment, by forming the muffler chamber 81 by disposing the partition member 82 between the end wall of the enclosed container 80 and the subsidiary bearing 9, each suction passage is the shortest, and troubles due to pulsation occurring in each suction passage can be avoided.

Also according to the exemplary embodiment, by extending the utmost downstream end of the suction pipe 51 connected to the compressor external suction piping system up to the center of the muffler chamber 50, and disposing the utmost downstream end above the opening ends of the first communication pipe 64 and second communication pipe 65 to the muffler chamber 50, the gas-liquid mixed refrigerant gas flowing into the muffler chamber 50 from the external suction piping system of the compressor is prevented from flowing directly into the first compression chamber 26 and second compression chamber 27.

In the exemplary embodiment, moreover, the first blade 14 and second blade 24 are disposed at equal interval in the cylinder block 11, but the same action and effect are obtained if more blades are disposed at equal interval.

Embodiment 3

Figure 5:
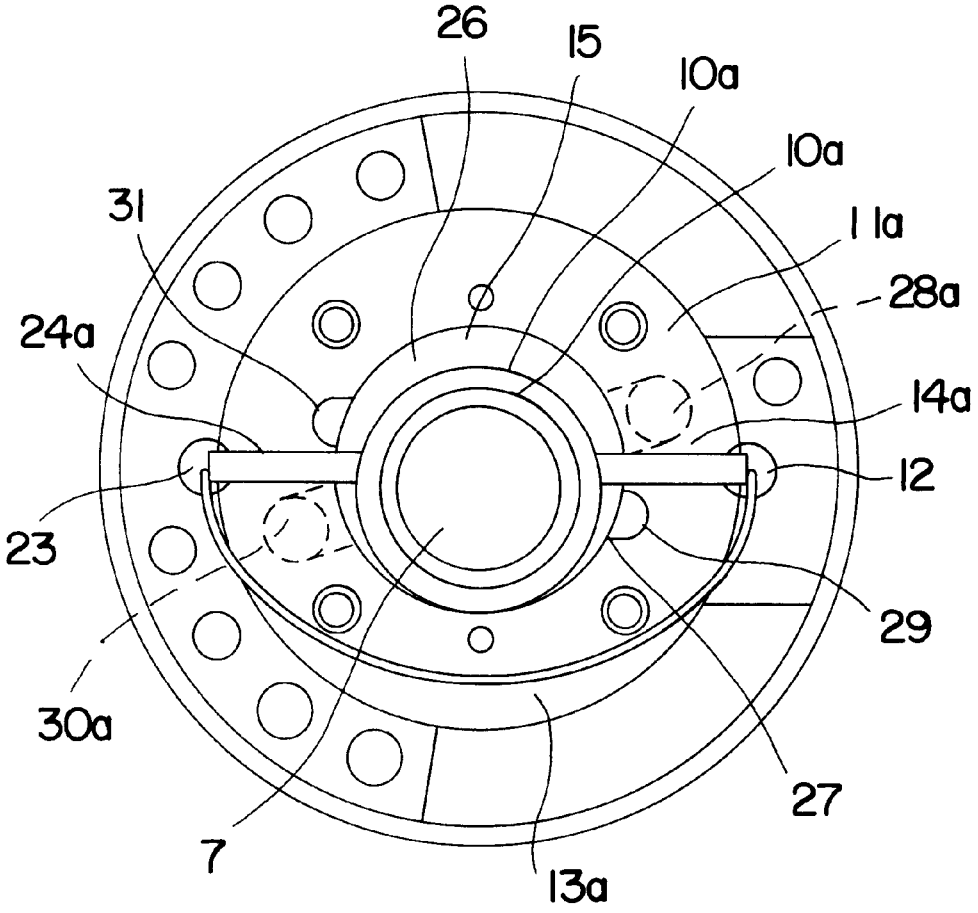
FIG. 5 is a lateral sectional view of a rolling piston type rotary refrigerant compressor showing a further exemplary embodiment of the present invention.
Figure 8:
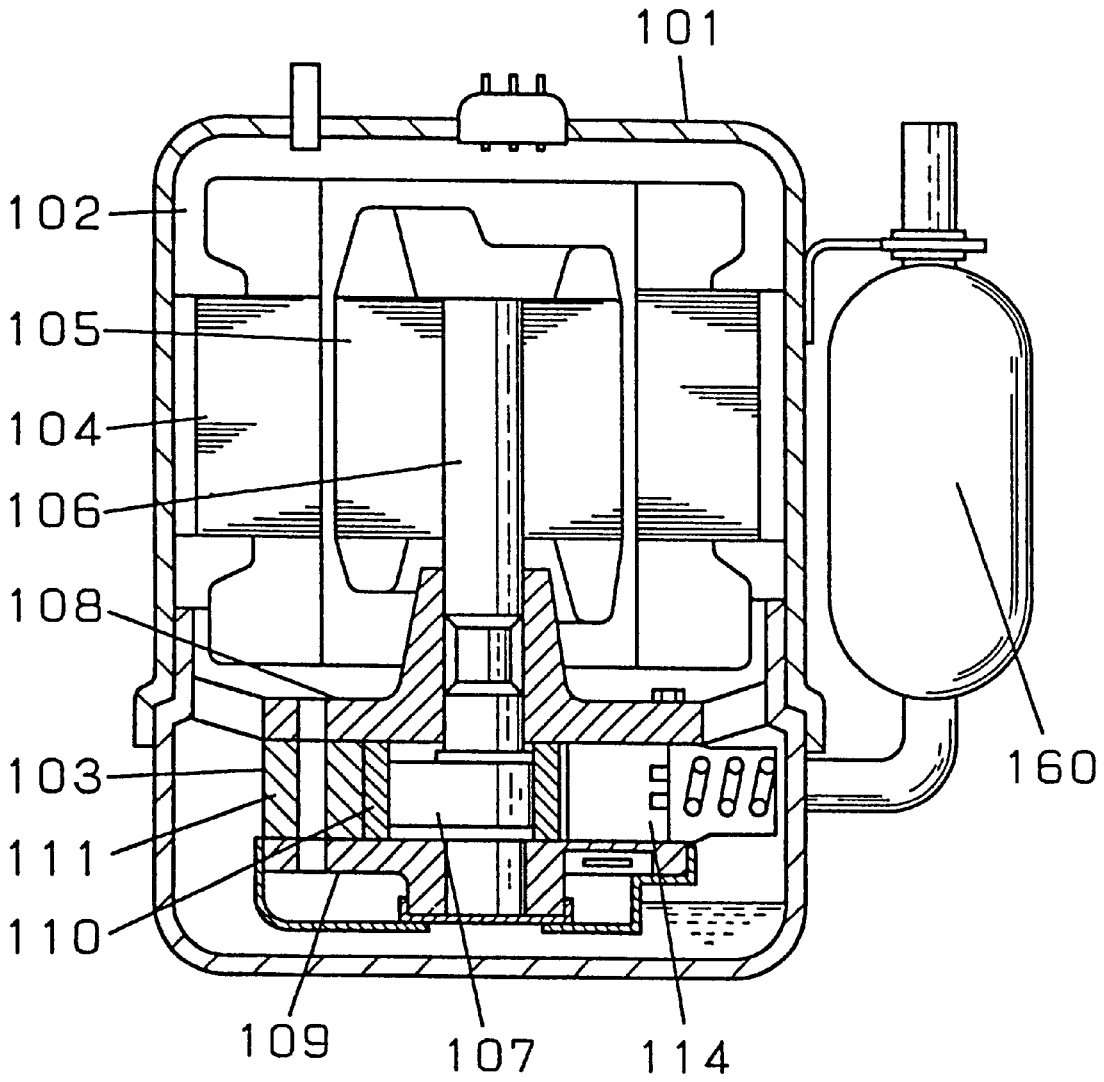
FIG. 8 PRIOR ART
FIG. 8 is a longitudinal sectional view of a conventional rolling piston type rotary compressor.
Figure 9:
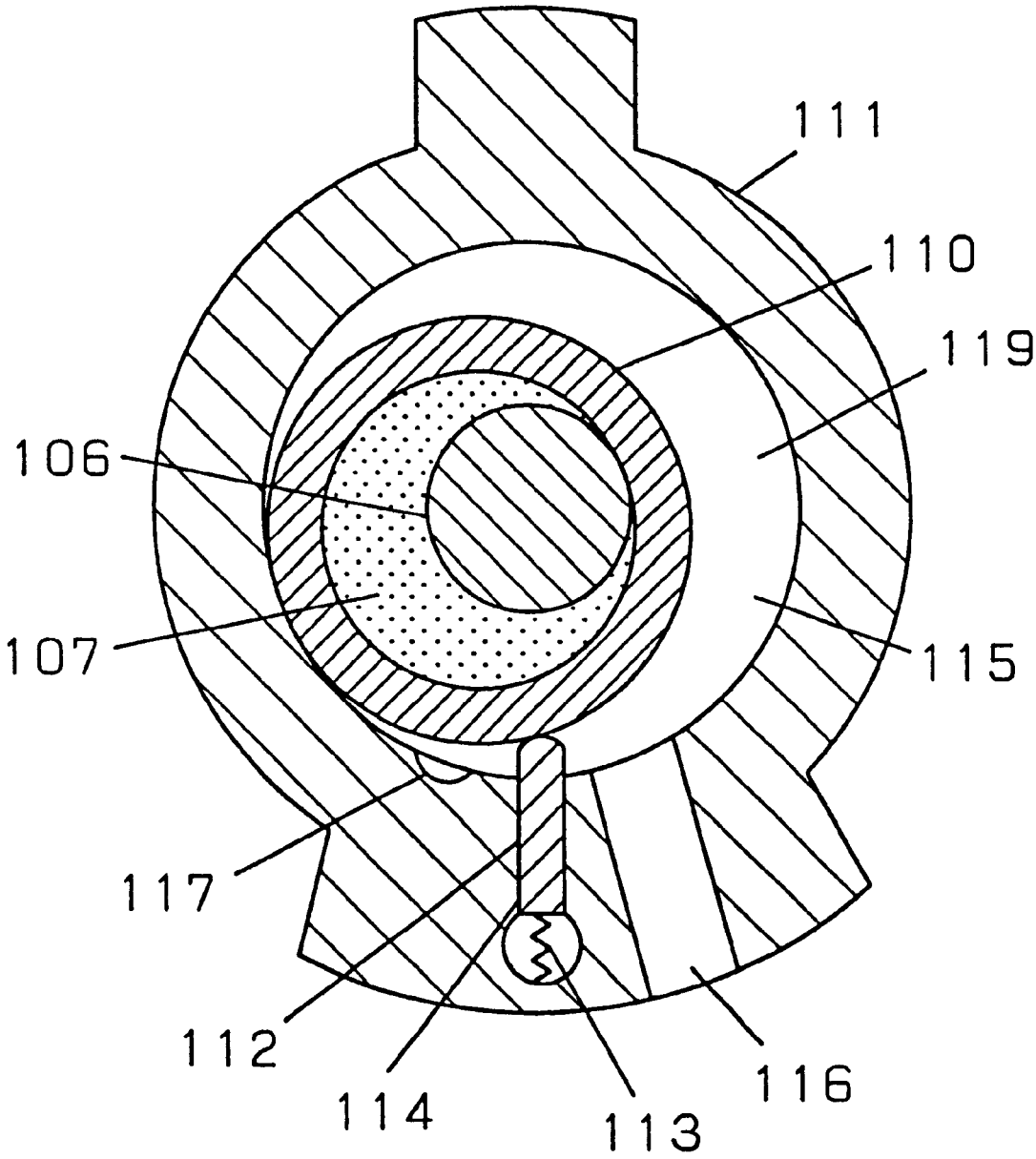
FIG. 9 PRIOR ART
FIG. 9 is a lateral sectional view of the compression unit of the compressor shown in FIG. 8.
Figure 10:
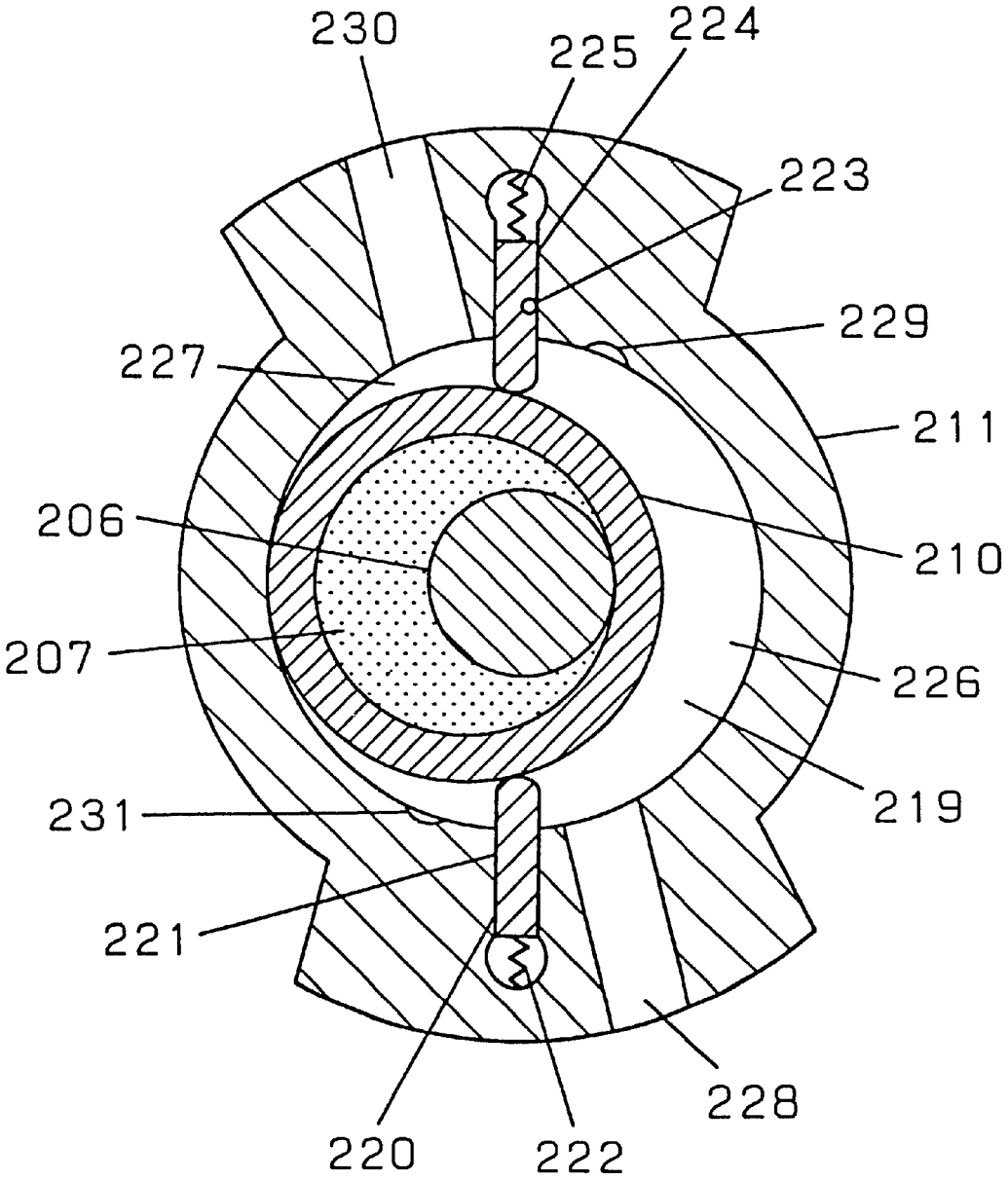
FIG. 10 PRIOR ART
FIG. 10 is a lateral sectional view of a compression unit of another conventional rolling piston type rotary compressor.
Figure 11:
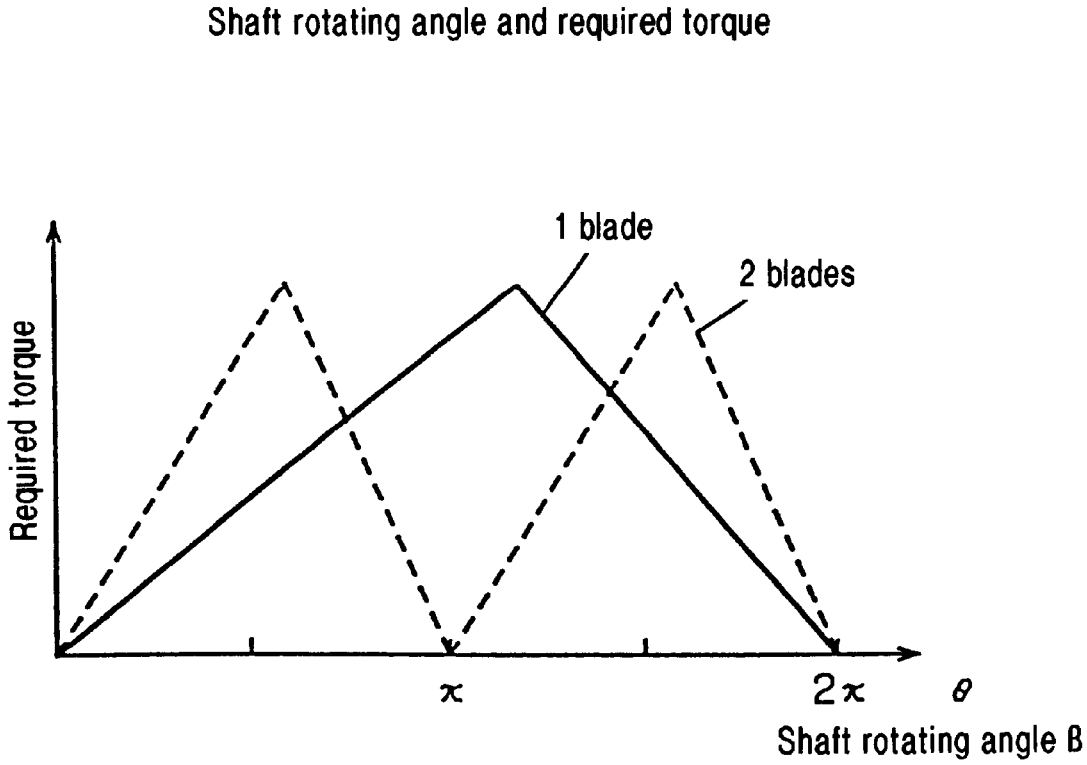
FIG. 11 PRIOR ART
FIG. 11 is a load torque fluctuation characteristic diagram of the compressor shown in FIG. 10.
Figure 12:
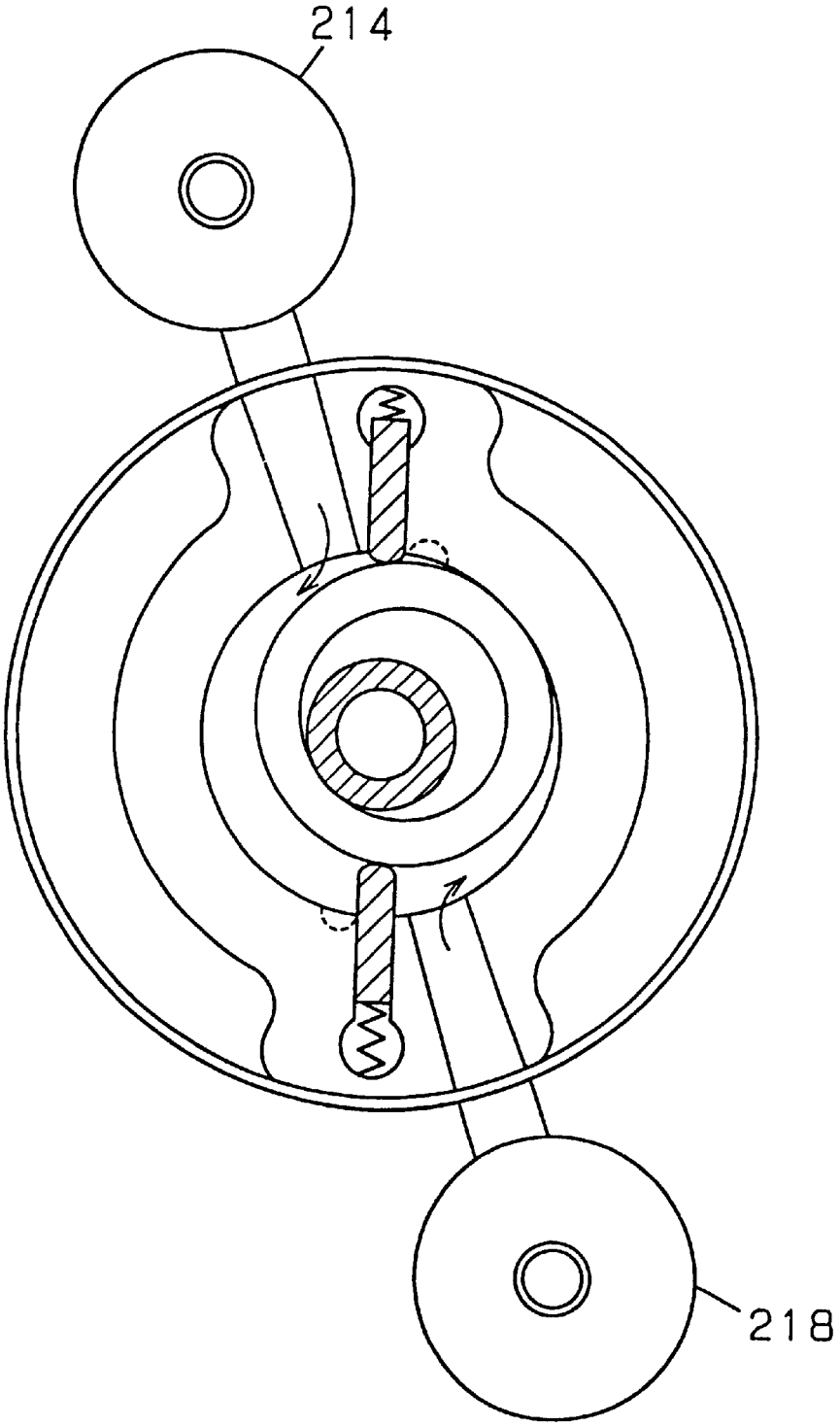
FIG. 12 PRIOR ART
FIG. 12 is a lateral sectional view of the compressor shown in FIG. 8.
Figure 13:
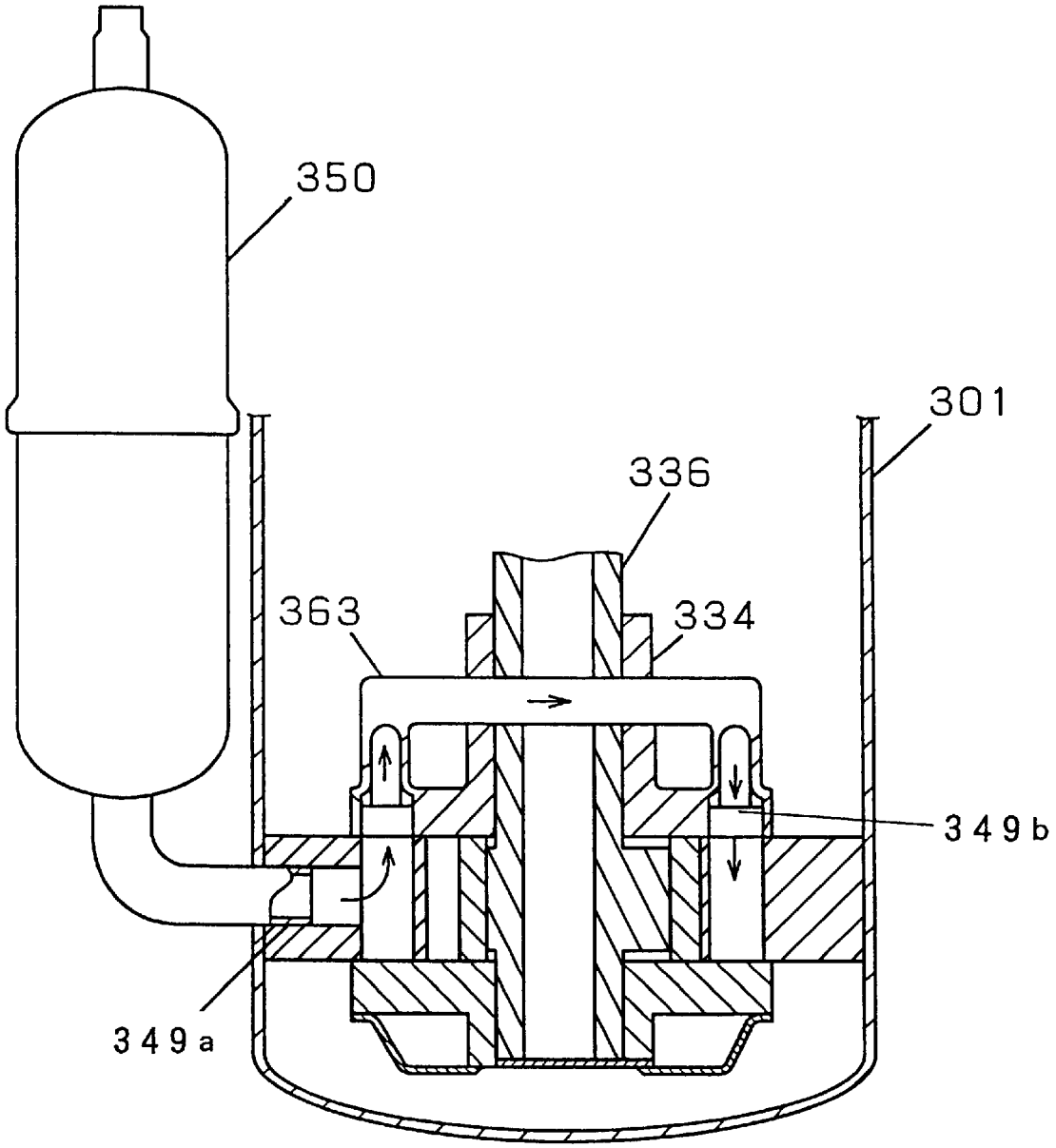
FIG. 13 PRIOR ART
FIG. 13 is an longitudinal sectional view of a further conventional rolling piston type rotary compressor.

As shown in FIG. 5, a roller 10 is double rollers comprising an inside roller 10*a* and an outside roller 10*b*, and the outer circumference of the inside roller 10*a* slides on the inner circumference of the outside roller 10*b*. The axial dimension of the inside roller 10*a* is set smaller than the axial direction of the outside roller 10*b* so that oil film may not be formed between the side of the inside roller 10*a* and the side of the main bearing 8 and subsidiary bearing 9, and hence the lubricating oil supplied into the inside of the inside roller 10*a* may be supplied to the inner circumference of the outside roller 10*b*.

A first blade 14*a* is fitted to a first guide groove 12 formed in a cylinder block 11*a*, and the leading end of the first blade 14*a* is pressed to the outside roller 10*b* by a spring device 13*a*. A second blade 24*a* is fitted to a second guide groove 23*a* provided at the opposite side position, and the leading end of the second blade 24*a* is pressed to the outside roller 10*b* by the spring device 13*a*.

A first suction port 28*a* and a second suction port 30*a* communicating with a first compression chamber 26 and a second compression chamber 27 partitioned by the first blade 14*a* and the second blade 24*a* are opened to the inner circumference of a cylinder 15 provided in the cylinder block 11*a*. A first discharge port 29 and a second discharge port 31 are disposed at symmetrical positions to the mounting side of the main bearing 8 of the cylinder block 11*a*.

In thus constituted rolling piston type rotary refrigerant compressor, the flow of lubricating oil, and operation of the roller 10, first blade 14*a* and second blade 24*a* are explained below.

The lubricating oil supplied into the inside roller 10*a* by pumping means (not shown) assembled in the drive shaft 6 is fed into the outside roller 10*b* through the side of the inside roller 10*a* by the differential pressure of the first compression chamber 26 and second compression chamber 27 and the centrifugal force.

The lubricating oil is fed into the inner circumference of the outside roller 10*b* also through an oil hole (not shown) provided penetrating through inside and outside of the inside roller 10*a*. By this supply of lubricating oil, the sliding surfaces of the inside roller 10*a* and outside roller 10*b* keep an oil film forming state.

The first blade 14*a* and second blade 24*a* obtaining the thrusting force by the lubricating oil pressure and spring device (wire spring) 13*a* in the first guide groove 12 and second guide groove 23 communicating with the oil sump 35 in which the discharge pressure acts are pressed to the outer circumference of the outside roller 10*b*. As explained in FIG. 7, the thrusting force to the first blade 12*a* varies with the pressure of the lubricating oil in the first guide groove 12 and the differential pressure in the first compression chamber 26, while the thrusting force to the second blade 24*a* varies with the pressure of the lubricating oil in the second guide groove 23 and the differential pressure in the second compression chamber 27.

That is, as shown in FIG. 7, the thrusting forces acting on the first blade 12 and second blade 24 are not equal to each other in any timing, and the magnitude of the thrusting forces is exchanged in every half revolution while the drive shaft 6 makes one revolution.

The outside roller 10*b* in a form being held from both sides by the first blade 14*a* and second blade 24*a* shown in FIG. 5 is extremely limited in the rotary motion in the rotating direction of the drive shaft 6. As shown in FIG. 5, the outside roller 10*b* receiving the compressed refrigerant gas pressure in the second compression chamber 27 in the midst of compression slips on the inside roller 10*a* while being supported by the inside roller 10*a*. Further, the crank 7 of the drive shaft 6 for supporting the inside roller 10*a* slips on the inside roller 10*a*.

That is, the leading ends of the crank 7 of the drive shaft 6, inside roller 10*a*, outside roller 10*b*, first blade 14*a*, and second blade 24*a* slip on each other. As a result, the sliding speed between the outside roller 10*b* and the leading end of the first blade 14*a*, and that between the outside roller 10*b* and second blade 24*a* maintain a very low speed, thereby preventing wear of the leading ends of the first blade 14*a* and second blade 24*a*. The outer circumference of the outside roller 10*b* rotating at very low speed is coated with the lubricating oil mixed in the refrigerant gas, and along with rotation of the outside roller 10*b*, it is gradually supplied up to the leading ends of the first blade 14*a* and second blade 24*a*, and wearing is prevented.

Thus, according to the embodiment, the roller 10 is double rollers consisting of inside roller 10*a* and outside roller 10*b*, and the outer circumference of the inside roller 10*a* slides on the inner circumference of the outside roller 10*b*. In this constitution, the inside roller 10*a* sliding on the outer circumference of the crank 7 of the drive shaft 6 slides on the inner circumference of the outside roller 10*b*. Moreover, the outside roller 10*b* receives the frictional resistance of the leading ends of the first blade 14*a* and second blade 24*a*, causing an extreme slipping against the inside roller 10*a*, and slightly rotates. The outside roller 10*b* slips slightly between the leading ends of the first blade 14*a* and second blade 24*a*, and the outer circumference of the outside roller 10*b* can decrease the friction of the leading ends of the first blade 14*a* and second blade 24*a*.

In the embodiment, for rotary motion of the outside roller 10*b*, the thrusting force to the first blade 14*a* and second blade 24*a* is set. In this constitution, as the outside roller 10*b* rotates, the lubricating oil adhered to the outer circumference of the outside roller 10*b* is gradually sent into the leading end sliding parts of the first blade 14*a* and second blade 24*a*, and is present for lubricating of the leading end sliding parts of the first blade 14*a* and second blade 24*a*, so that wear can be decreased.

Meanwhile, in the embodiment, the roller 10 consists of the inside roller 10*a* and outside roller 10*b*, but the roller 10 may be also composed of three or more rollers, and the same action and effect as in double rollers can be obtained.

Similarly, in the embodiment, the first blade 14*a* and second blade 24*a* are disposed in the cylinder 11*a* but three or more blades may be also disposed. In this case, the outside roller 10*b* rotates at an extremely low speed.

The foregoing embodiments relate to the refrigerant compressor, but the same action and effect are obtained in the case of other gas compressorsfor compressing other gases (such as oxygen, nitrogen, helium, air).

As is clear from the embodiments, in the compressor of the exemplary embodiment of the present invention, a common muffler chamber is provided between the suction port of each compression chamber and the compressor external suction piping system, and the suction passage from each suction port to the muffler chamber is set nearly at the same length. In this constitution, when part of the air sucked into each compression chamber flows back temporarily into each suction port, pulsations are generated in the suction passage in the same magnitude at a phase difference of 180 degrees. Accordingly, the suction efficiency of each compression chamber and each compression torque fluctuation due to effects of pulsation occur symmetrically. Therefore, the torque fluctuations during one revolution of the drive shaft can be dispersed, and the motor efficiency is enhanced, while the vibration of the compressor piping system can be reduced.

Pulsation of air propagating to the muffler chamber through the suction passage is attenuated in the muffler chamber. That is, the air flowing back from the suction passage is sucked into other suction passage through the muffler chamber, and the air pulsation is attenuated. As a result, since pulsation of suction air is not propagated to the compressor external suction piping system, vibration of the compressor external suction piping system can be decreased.

Besides, extreme oversupply of suction air does not occur, and excessive compression load is prevented.

In a compressor in accordance with a further exemplary embodiment of the present invention, each suction passage from each suction port to the muffler chamber is disposed so that the fluid flow direction may not changeseverely. In this constitution, the passage resistance is extremely small when part of the air sucked into the compression chamber flows back into the muffler chamber through each suction port. Therefore, elevation of pressure of the gas remaining in the compression chamber is extremely small. As a result, lowering of compression efficiency can be suppressed.

In a compressor in accordance with a futher exemplary embodiment of the present invention, a drive shaft is supported by being disposed at a position on an opposite side of the motor, a muffler chamber is disposed at a subsidiary bearing side adjacent to the cylinder block, and a discharge port and a discharge valve are disposed at a main bearing side disposed at the motor side, while supporting the drive shaft together with the subsidiary bearing. In this constitution, if the muffler chamber is disposed, the distance between the main bearing and subsidiary bearing is short, and deformation of drive shaft can be decreased. Hence, vibration of the compressor and wear of the bearing due to imbalance of the rotary driving system can be decreased.

Since the muffler chamber in a space necessary for absorption of pulsation can be installed in a desired form, the pulsation attenuation effect can be increased.

In a compressor in accordance with a further exemplary embodiment of the present invention, each suction passage is disposed by penetrating the subsidiary bearing in the axial direction. In this constitution, the suction passage to the muffler chamber is short, and hence the magnitude of pulsation decreases. As a result, vibration of the compressor external suction piping system is decreased, and the compressor suction efficiency can be enhanced.

In a compressor in accordance with a further exemplary embodiment of the present invention, each suction hole opening in each compression chamber is formed by disposing a notch in the cylinder wall, at the end of the cylinder block at the side adjacent to the subsidiary bearing, and this notch is connected to the suction passage. In this constitution, when part of the air sucked into the compression chamber is returned to the muffler chamber through the suction port, the flow direction of the air is not changed so much. Hence, exhaust from the compression chamber to the muffler chamber is easy. As a result, elevation of pressure of suction air in the compression chamber before start of compression stroke is small, and lowering of compression efficiency can be suppressed.

In a compressor in accordance with a further exemplary embodiment of the present invention, the end of suction passage is formed opposite to both the notch and the compression chamber. In this constitution, when part of the air sucked into the compression chamber is returned to the muffler chamber through the suction port, exhaust from the compression chamber to the muffler chamber is further easier. As a result, elevation of pressure of suction air into the compression chamber before start of compression stroke hardly occurs, and lowering of compression efficiency can be prevented.

In a compressor in accordance with a further exemplary embodiment of the present invention, the muffler chamber is formed by disposing a partition member between the end wall of the enclosed container and the subsidiary bearing. In this constitution, each suction passage is shortest, pulsation occurring in each suction passage is suppressed, troubles due to pulsation is avoided, so that enhancement of compressor efficiency and decrease of vibration can be realized.

In a compressor in accordance with a further exemplary embodiment of the present invention, the muffler chamber is disposed outside of the end wall of the enclosed container at the subsidiary bearing side, and the suction passage is formed by penetrating through the end wall of the enclosed container. In this constitution, the suction passage is shortened, heating of the muffler chamber is prevented, and compression efficiency is enhanced.

In a compressor in accordance with a further exemplary embodiment of the present invention, the muffler chamber is disposed outside of the end wall of the enclosed container at the subsidiary bearing side, and the suction passage is formed by penetrating through the subsidiary bearing and the end wall of the enclosed container. In this constitution, the suction passage is further shortened, pulsation occurring in the suction port route is decreased, heating of suction air is prevented, and the compression efficiency is further enhanced.

In a compressor in accordance with a further exemplary embodiment of the present invention, mainly the muffler chamber is held in the enclosed container by the communicating pipe for composing the suction passage. In this constitution, the muffler chamber can be easily disposed in the enclosed container, and the compressor can be lowered in cost.

In a compressor in accordance with a further exemplary embodiment of the present invention, the opening position of each suction passage into the muffler chamber is disposed almost symmetrically about the muffler chamber in the center. In this constitution, the pulsation attenuation action in the muffler chamber can be increased, and vibration of suction piping system can be decreased.

In a compressor in accordance with a further exemplary embodiment of the present invention, the utmost downstream end of the suction pipe connected to the external suction piping system of the compressor is extended up to the center of the muffler chamber, and the utmost downstream end is disposed higher than the opening end of each suction passage into the muffler chamber. In this constitution, the gas-liquid mixed fluid flowing into the muffler chamber from the external suction piping system of the compressor is prevented from flowing directly into each compression chamber, and the compressor durability is enhanced while avoiding liquid compression.

In a compressor in accordance with a further exemplary embodiment of the present invention, the utmost downstream end of the suction pipe connected to the compressor external suction piping system is disposed nearly in the common center to each opening of each suction passage to the muffler chamber. In this constitution, the pulsation attenuation action in the muffler chamber can be extremely increased, and the compression efficiency is enhanced and the vibration of suction piping system can be decreased.

In a compressor in accordance with a further exemplary embodiment of the present invention, the utmost downstream end of the suction pipe connected to the external suction piping system of the compressor is extended nearly up to the center of the muffler chamber, and means for changing the flow direction of the suction fluid by 90 degrees or more is disposed until the suction fluid flows into each suction passage from the opening at the utmost downstream end of the suction pipe. In this constitution, the gas-liquid mixed fluid flowing into the muffler chamber through the suction pipe is prevented from flowing directly into the compression chamber. As a result, the fluid in the liquid state heavier in specific gravity is separated from the gas by its inertial force, and only the gas smaller in specific gravity is sucked into the compression chamber through the suction passage. Accordingly, liquid compression in the compression chamber is prevented, and the durability of the compressor is enhanced.

In a compressor in accordance with a further exemplary embodiment of the present invention, the roller is double rollers composed of inside roller and outside roller, and the outer circumference of the inside roller is designed to slide on the inner circumference of the outside roller. In this constitution, the inside roller sliding on the outer circumference of the crank of the drive shaft slides on the inner circumference of the outside roller, and the outside roller receives a frictional resistance against the ends of plural blades to cause an extreme slipping against the inside roller, and hence rotates at a very slow speed. As a result, the outside roller makes a slight slipping motion against the ends of the plural blades, and hence the wear of the outer circumference of the outside roller and the leading end of the blade is extremely decreased, and the durability is enhanced outstandingly.

In a compressor in accordance with a further exemplary embodiment of the present invention, a thrusting force is set on each blade so that the outside roller may rotate. In this constitution, as the outside roller rotates, the lubricating oil adhered to the outer circumference of the outside roller is gradually sent into the leading end sliding parts of the blades, and is presented for lubrication of the leading end sliding parts of the blades. Accordingly, an oil film is formed between the outer circumference of the outside roller and the leading ends of the blades, so that the durability may be further enhanced.

What is claimed is:

1. A compressor comprising:

(a) a motor, (b) compressing means including (1) a cylinder block having a cylinder with a cylindrical inner side, (2) a plurality of blades moving back and forth within the cylinder, and (3) a plurality of compression chambers into which the plurality of blades move, each compression chamber of the plurality of compression chambers having a suction port and a discharge port, (c) a muffler chamber communicating with each suction port of the plurality of compression chambers, (d) a plurality of passages disposed between a respective suction port and the muffler chamber, each passage of said plurality of passages being substantially the same length, (e) a main bearing disposed at a side of the motor, adjacent to the cylinder block, for supporting the drive shaft, and (f) a subsidiary bearing installed at an opposite side of the motor, wherein said muffler chamber is disposed at a side of the subsidiary bearing, and each discharge port is disposed at a side of the main bearing.

2. A compressor of claim 1, wherein said each passage is disposed so as to penetrate through the subsidiary bearing in the axial direction.

3. A compressor comprising:

(a) a motor, (b) compressing means including (1) a cylinder block having a cylinder with a cylindrical inner side, (2) a plurality of blades moving back and forth within the cylinder, and (3) a plurality of compression chambers into which the plurality of blades move, each compression chamber of the plurality of compression chambers having a suction port and a discharge port, (4) a main bearing disposed at a side of the motor, adjacent to the cylinder block, for supporting the drive shaft, and (5) a subsidiary bearing installed at an opposite side of the motor, (c) a muffler chamber communicating with each suction port of the plurality of compression chambers, (d) a plurality of passages disposed between a respective suction port and the muffler chamber, each passage of said plurality of passages being substantially the same length, wherein the muffler chamber is disposed at a side of the subsidiary bearing, each discharge port is disposed at a side of the main bearing, and each passage penetrates through the wall of the enclosed container and the subsidiary bearing.

4. A compressor comprising:

(a) a motor, (b) compressing means including (1) a cylinder block having a cylinder with a cylindrical inner side, (2) a plurality of blades moving back and forth within the cylinder, and (3) a plurality of compression chambers into which the plurality of blades move, each compression chamber of the plurality of compression chambers having a suction port and a discharge port, (c) a muffler chamber communicating with each suction port of the plurality of compression chambers, (d) a plurality of passages disposed between a respective suction port and the muffler chamber, each passage of said plurality of passages being substantially the same length, and (e) external piping communicating with the muffler chamber wherein a part of the external piping is positioned in the muffler chamber, and an end of the external piping is positioned nearly in the center of the muffler chamber.

5. A compressor comprising:

(a) a motor, (b) compressing means including (1) a cylinder block having a cylinder with a cylindrical inner side, (2) a plurality of blades moving back and forth within the cylinder, and (3) a plurality of compression chambers into which the plurality of blades move, each compression chamber of the plurality of compression chambers having a suction port and a discharge port, (c) a muffler chamber communicating with each suction port of the plurality of compression chambers, (d) a plurality of passages disposed between a respective suction port and the muffler chamber, each passage of said plurality of passages being substantially the same length, and (e) external piping communicating with the muffler chamber wherein an end of the external piping positioned in the muffler chamber is positioned nearly in the center between said each passage.

6. A compressor comprising:

(a) a motor, (b) compressing means including (1) a cylinder block having a cylinder with a cylindrical inner side, (2) a plurality of blades moving back and forth within the cylinder, and (3) a plurality of compression chambers into which the plurality of blades move, each compression chamber of the plurality of compression chambers having a suction port and a discharge port, (c) a muffler chamber communicating with each suction port of the plurality of compression chambers, (d) a plurality of passages disposed between a respective suction port and the muffler chamber, each passage of said plurality of passages being substantially the same length, and roller means connected to a drive shaft coupled to the motor, for moving along the inner side of the cylinder, wherein said plurality of blades have a first blade and a second blade, wherein said plurality of compression chambers further have (a) a first compression chamber enclosed by an inner side of the cylinder block, an outer side of the roller means and the first blade, and (b) a second compression chamber enclosed by the inner side of the cylinder block, the outer side of the roller means and the second blade, and each passage has (1) a first communication pipe disposed between the first compression chamber and the muffler chamber, and a second communication pipe disposed between the second compression chamber and the muffler chamber.

7. A compressor of claim 6, wherein the first communication pipe and second communication pipe have a nearly the same length.

8. The compressor of claim 1, wherein each of said plurality of passages functions both as i) a suction passage and ii) a discharge passage.

9. The compressor of claim 3, wherein each of said plurality of passages functions both as i) a suction passage and ii) a discharge passage.

10. The compressor of claim 4, wherein each of said plurality of passages functions both as i) a suction passage and ii) a discharge passage.

11. The compressor of claim 5, wherein each of said plurality of passages functions both as i) a suction passage and ii) a discharge passage.

12. The compressor of claim 6, wherein each of said plurality of passages functions both as i) a suction passage and ii) a discharge passage.

* * * * *